United States Patent [19]

Monsees

[11] Patent Number: 5,025,612

[45] Date of Patent: Jun. 25, 1991

[54] INVERTED TRAY CONTAINER LOADING APPARATUS

[75] Inventor: Claude E. Monsees, Fortmill, S.C.

[73] Assignee: Roberts Systems, Inc., Charlotte, N.C.

[21] Appl. No.: 443,666

[22] Filed: Nov. 29, 1989

[51] Int. Cl.[5] ..... B65B 5/06; B65B 39/00; B65B 63/00

[52] U.S. Cl. ..... 53/530; 53/171; 53/243; 53/580

[58] Field of Search ..... 53/242, 243, 247, 249, 53/250, 251, 253, 529, 530, 171, 531, 540, 143, 392, 580; 414/222

[56] References Cited

U.S. PATENT DOCUMENTS

| | | | |
|---|---|---|---|
| 1,243,406 | 10/1917 | Hawthorne | 53/243 X |
| 2,749,687 | 6/1956 | Imbs | 53/249 X |
| 3,107,793 | 10/1963 | Frank | 53/249 X |
| 3,139,714 | 7/1964 | Hall | 53/529 X |
| 3,505,777 | 4/1970 | Tsutsumi | 53/247 X |
| 3,668,823 | 6/1972 | Larson | 53/250 |
| 3,854,270 | 12/1974 | Cloud et al. | 53/243 X |
| 4,028,864 | 6/1977 | Bell | 53/529 X |
| 4,141,193 | 2/1979 | Joa | 53/529 |
| 4,242,854 | 1/1981 | Nissen | 53/529 |
| 4,433,526 | 2/1984 | Nord | 53/247 X |

*Primary Examiner*—John Sipos
*Assistant Examiner*—Linda B. Johnson
*Attorney, Agent, or Firm*—Bailey & Hardaway

[57] ABSTRACT

A process and apparatus for packaging a plurality of individual packages containing fluent material is disclosed.

6 Claims, 3 Drawing Sheets

FIG.4
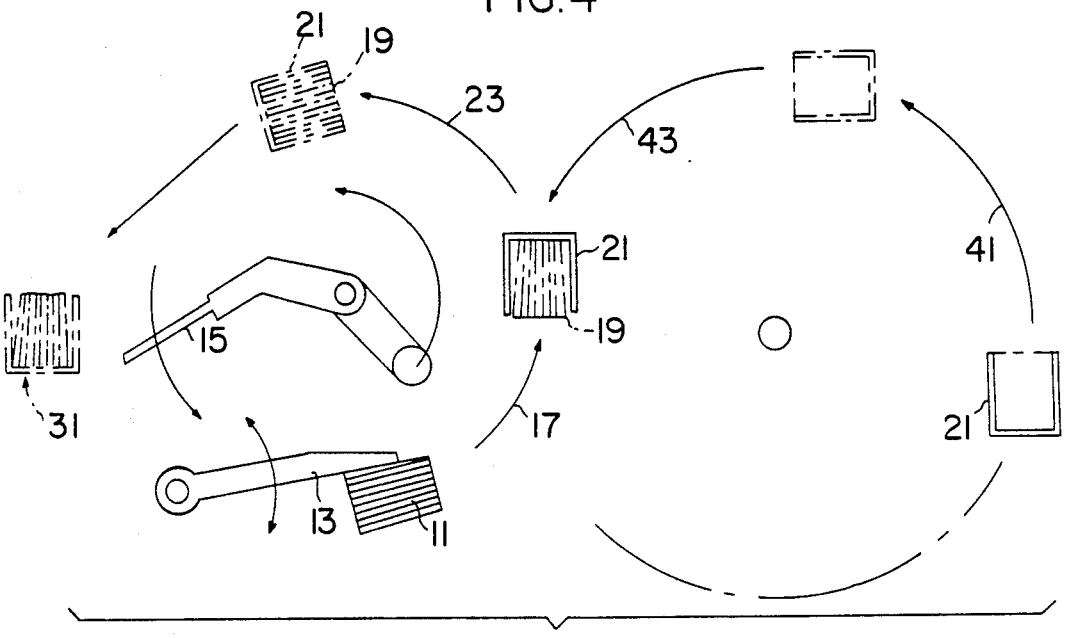
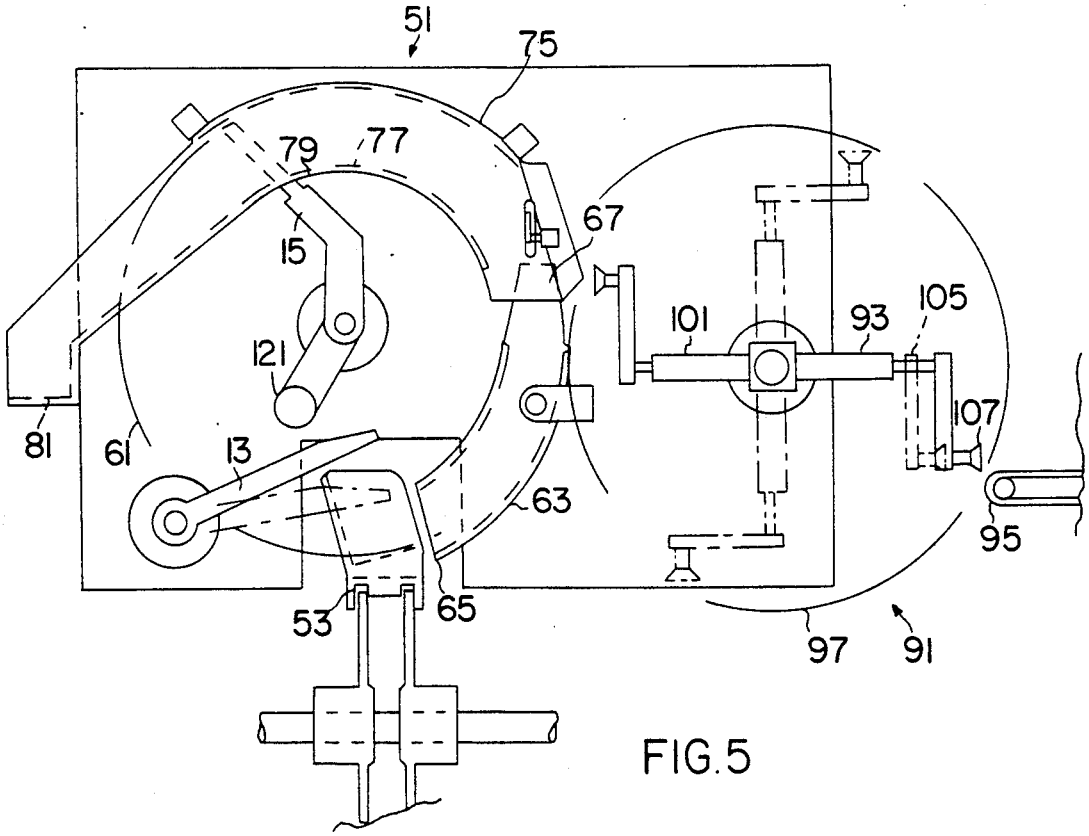
FIG.5

INVERTED TRAY CONTAINER LOADING APPARATUS

BACKGROUND OF THE INVENTION

This invention relates generally to the art of packaging and more particularly to a process and apparatus for packaging individual packages of fluent material.

In the art of packaging, many apparatus have been provided which convey, place and contain articles which have well defined dimensions. These well defined dimensions generally tend to remain constant during movement and handling.

With regard to the handling of packages of fluent material, very few satisfactory means for automation have been developed. The deformable products have generally been the subject of an extensive amount of manual handling.

SUMMARY OF THE INVENTION

It is thus an object of this invention to provide a novel process and apparatus for the handling of individual packages having fluent material therein.

It is a further object of this invention to provide such a process and apparatus which permits the deformation brought about by the fluent material to be utilized as an advantage in the handling process.

These as well as other objects are accomplished by a process wherein individual packages having fluent material therein are stacked in a horizontal arrangement and moved about a circle to assume a vertical orientation. That circle is intersected with an inverted tray container to receive the vertical stack. The deformation of the fluent material within the vertical stack assumes a wedge shape to facilitate loading into the inverted tray. The inverted tray continues around the circle until an upright position is assumed. The apparatus for carrying out the process comprises a rotary sweep arm which tangentially intersects a plurality of individually packaged products in a horizontal stack and moves the stack into an arcuate loading horn which supports an inverted tray at an exit thereon to receive the stack upon further movement of the rotary sweep arm when the stack is in a vertical orientation. An arcuate chute is arched about the circle for receiving the tray having a fluent product therein and permits the tray to assume an upright position as the rotary sweep arm continues about the circle.

BRIEF DESCRIPTION OF DRAWINGS

FIG. 4 of the drawings schematically illustrates the movement of individual packages within stacks into inverted loading trays.

FIG. 5 of the drawings is an end view in partial phantom showing the apparatus carrying out the process schematically illustrated in FIG. 4 of the drawings.

DETAILED DESCRIPTION

In accordance with this invention, it has been found that a plurality of individual packages with each package having a fluent material therein, may be further packaged in a tray container in a manner so as to take advantage of the deformation which occurs as the individual packaged articles are subjected to motion and the action of gravity. Such individual packages may generally take the form of particulate material such as sugar, salt, pepper or any other individual articles such as beverage mixes and the like. Such articles have always suffered from the problem of deformation due to gravity in the process of packaging. According to this invention, however, it has been surprisingly found that this phenomenon may be taken advantage of to ease the loading process. This advantage, in essence, is brought about by loading a tray container when the tray container is in an up-side-down position. Various other advantages and features will become apparent from the following description which is made with reference to the various figures of drawings.

Figure 1:
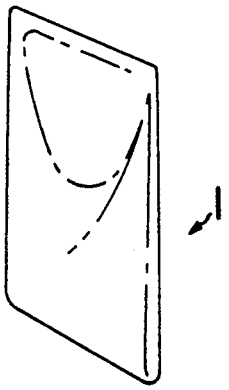
FIG. 1 of the drawings illustrates an individual package having fluent material therein in a perspective view.

FIG. 1 of the drawings illustrates an individual package 1 which may be an individual package of sugar, salt, beverage mix or the like. The goal of this invention is to get a plurality of packages 1 into a merchandising or shipping tray 3, shown in FIG. 2.

Figure 3:
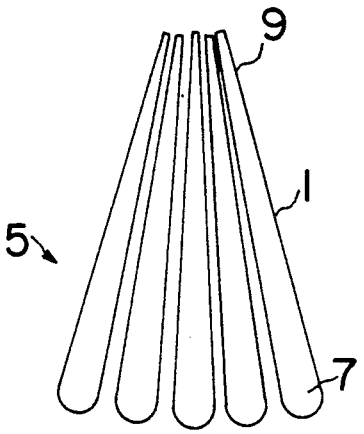
FIG. 3 of the drawings is an end view of a plurality of individual packages in a vertical orientation deformed by the action of gravity of the fluent material therein.

FIG. 3 of the drawings illustrates a plurality 5 of the individual packages being deformed by the action of gravity. It is seen from FIG. 3 that in a vertical orientation, the bottom 7 of each individual article 1 becomes enlarged due to gravity forcing the fluent material to the bottom. The top 9 of the individual packages 1 thus become diminished and pointed. In effect, the vertical stack 5 becomes wedge-shaped when in the vertical orientation.

FIG. 4 of the drawings thus schematically illustrates the process of this invention wherein a horizontal stack 11 is compressed by a tamper 13 to be contacted by a rotary sweep arm 15 and then moved about an arc of a circle, designated here by arrow 17. It is seen that as the horizontal stack 11 moves along the course of arrow 17, it then becomes a vertically oriented stack 19, assuming the shape parameters illustrated in the vertical stack 5 of FIG. 3. When this wedge-shape occurs, an inverted tray container illustrated here as 21 is placed into the course of travel about the arc 17 so that sweep arm then continues the movement of the vertical stack 19 and tray 21 about the course of arrow 23 where stack 19 and tray 21 begin to assume an upright position due to continued course of travel about the circle and ultimately arrive in an upright position as illustrated at 31.

Further viewing FIG. 4 it is seen that container 21 begins in an upright position, moves about the arc of arrow 41 and arrow 43 to arrive in the position illustrated at the position of inverted tray 21.

FIG. 5 of the drawings illustrates an apparatus 51 for carrying out the process of this invention. Illustrated in the apparatus 51 are the rotary sweep arm 15 and package tamp 13, referred to in FIG. 4.

Figure 6:
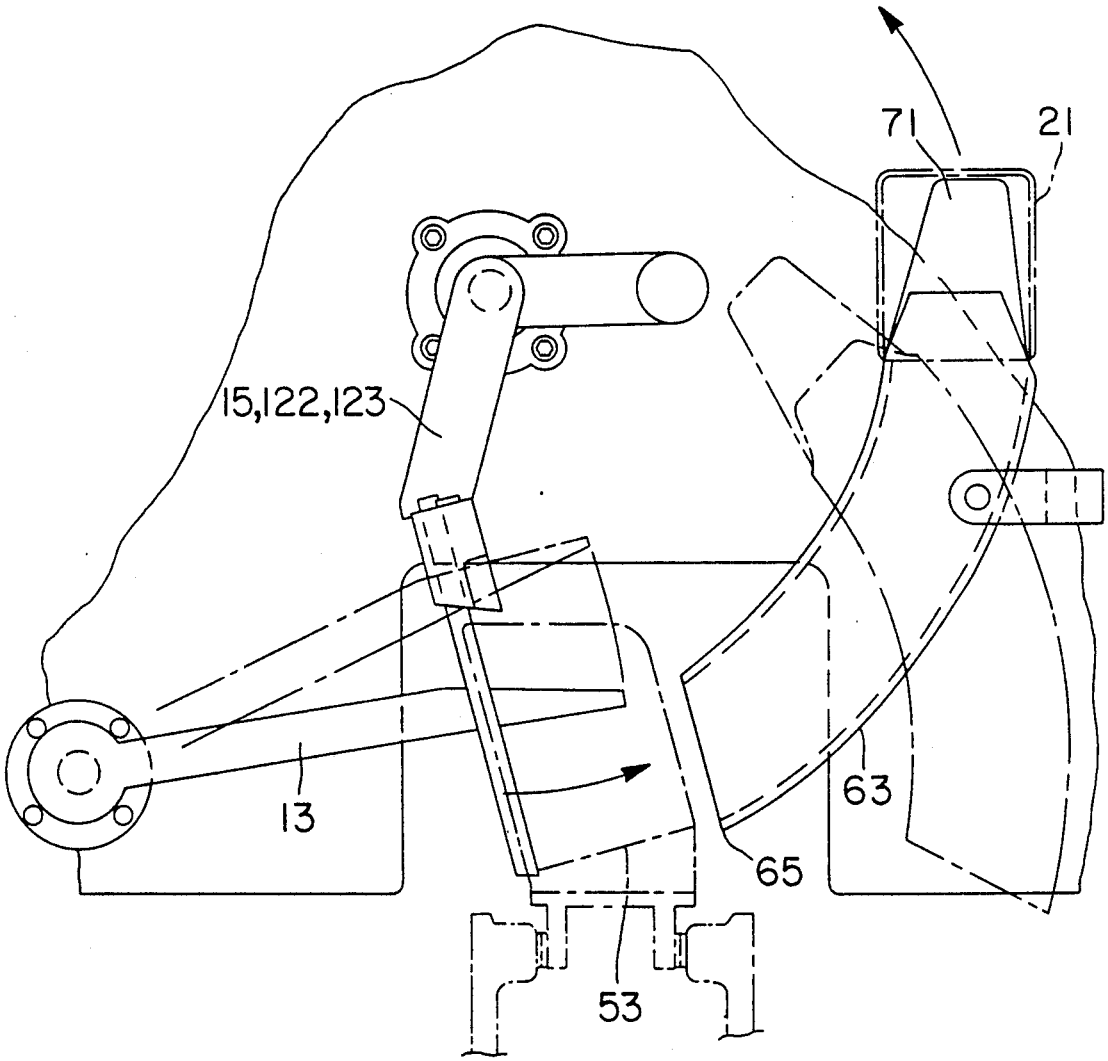
FIG. 6 of the drawings is an enlarged partial view of the apparatus of FIG. 5.

The horizontal stack of packages as illustrated at 11 in FIG. 4 is provided by means for supplying a plurality of products for packaging; illustrated here as a bucket conveyor 53. The horizontal stack within conveyor 53 is tamped by tamper 13 and tangentially intersected by rotary sweep arm 15 which moves about a circle; generally illustrated here as 61. An arcuate loading horn 63 receives the stack at an entrance end 65 and forces the stack to continue about the circle defined by 61 until it reaches an exit end 67. At 67, the stacked articles have assumed a vertical orientation as illustrated at 21 in FIG. 4. Exit end 67 supports an inverted tray in the position indicated at 21 which is better illustrated in the enlarged view of FIG. 6 which illustrates an inverted container in phantom at 21'. Also illustrated are spring fingers 71 which are utilized to maintain the inverted container in position until forced off by the rotary sweep arm 15.

Referring again to FIG. 5, an arcuate chute 75 receives the inverted container as sweep arm 15 continues its motion about circle 61 on a lower surface 77 of chute 75. Chute 75 has slots illustrated at 79 through which rotary arm 15 has a limited passage for moving a filled tray through the chute 75. Upon reaching the position of rotary arm 15, gravity begins to act upon the loaded tray whereupon the loaded tray will exit from the chute at 81 and assume the position illustrated at 31 of FIG. 4.

It is seen that means for positioning the tray as generally illustrated at 91 of FIG. 5 comprise a rotary arm 93 which can contact a supply of containers as at 95 to move a container tray about a circle as defined by circle 97 and to tangentially intersect the circle 61 at the appropriate location illustrated by a rotary arm 101. Preferably each rotary arm 93 is pneumatically extendable as illustrated at 105 and operable through suction cups 107 to grip, lift and release a container tray.

Figure 2:
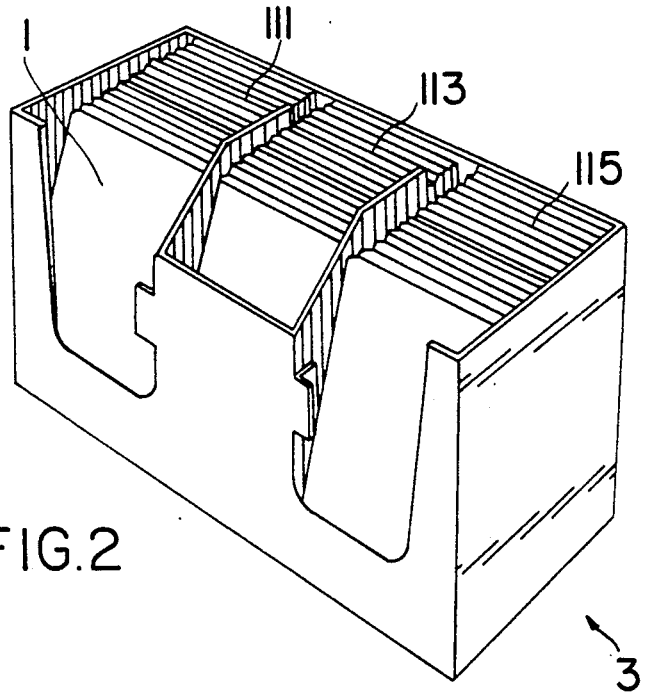
FIG. 2 of the drawings is a perspective view of a completed tray packaged with the individual packages.

It is preferred to operate with a plurality of stacks of articles so that the plurality of stack as illustrated at 111, 113 and 115 of FIG. 2 may be brought about. In this instance, three rotary sweep arms 15, 122, 123 would be utilized in conjunction with three tampers, all of which would be operable with a single loading horn and single chute.

Referring again to FIG. 5, as most of the actions illustrated herein are rotary, it is preferred to balance the rotary movements. It is thus seen that the rotary supply arms 93 and 95 of FIG. 5 operate in a balanced fashion. However, the rotary sweep arm 15 does not have a counterpart so it is therefore preferred to provide a counter weight 121 to moderate the rotational movement of the rotary sweep arm 15.

It is thus seen that the process and apparatus of this invention provide a novel process and apparatus for packaging a plurality of individual packages containing fluent material. It is further seen that the phenomenon of fluent material is positively taken advantage of to achieve an automated process for packaging such individual packages. As many variations will become apparent to those skilled in the art from the foregoing description, which is exemplary in nature, such variations are included within the spirit and scope of the invention as defined by the following appended claims.

That which is claimed:

1. A packaging apparatus comprising:

means for supplying a plurality of stacked products for packaging;

a rotary sweep arm, a portion of which is movable about a circle tangentially intersecting said plurality of stacked products;

an arcuate loading horn for receiving said plurality of stacked products as said rotary arm moves about said circle, said loading horn having an entrance end near said means for supplying a plurality of stacked products for packaging, and an exit end above said entrance end;

means for placing an inverted tray container over said exit end whereby said rotary sweep arm moves said plurality of stacked products from said means for supplying into said entrance end of said arcuate loading horn and out of said exit end and into said inverted tray container;

and arcuate chute, downstream, in the direction of movement of said rotary sweep arm, of said exit end of said arcuate loading horn, arched about said circle for receiving said inverted tray container having a plurality of stacked products therein as said rotary sweep arm continues about said circle, said arcuate chute permitting said inverted tray having product therein to assume an upright position as said tray traverses said chute and said rotary sweep arm continues about said circle.

2. The packaging apparatus according to claim 1 wherein said means for placing an inverted tray container over said exit end comprises:

a rotary supply arm for contacting and lifting an upright tray rotating said tray in a second circle adjacent the circle defined by said rotary sweep arm to invert said tray container and place said inverted tray container on said exit end of said loading horn.

3. The packaging apparatus according to claim 1 further comprising a tamper to compress said plurality of stacked products prior to said plurality of stacked products being moved by said rotary sweep arm.

4. The packaging apparatus according to claim 1 wherein said chute has a slot therein for permitting said rotary sweep arm to pass therethrough as said chute supports said tray container having said plurality of stacked products therein.

5. The packaging apparatus according to claim 1 further comprising a plurality of rotary sweep arms for contacting a plurality of stacks of said plurality of stacked products.

6. The packaging apparatus according to claim 1 wherein said means for supplying a plurality of stacked products for packaging comprises a bucket conveyor.

* * * * *